US006256005B1

(12) United States Patent
Kim

(10) Patent No.: US 6,256,005 B1
(45) **Date of Patent: *Jul. 3, 2001**

(54) DRIVING VOLTAGE SUPPLY CIRCUIT FOR LIQUID CRYSTAL DISPLAY (LCD) PANEL

(75) Inventor: Kwang-In Kim, Kyoungsangbuk-Do (KR)

(73) Assignee: Hyundai Electronics Industries Co., Ltd., Ichon-shi (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/018,307

(22) Filed: Feb. 3, 1998

(30) Foreign Application Priority Data

Feb. 3, 1997 (KR) ..... 97/3275

(51) Int. Cl.[7] ..... G09G 3/36
(52) U.S. Cl. ..... 345/88; 345/98
(58) Field of Search ..... 345/99–100, 150, 345/98, 94, 96, 209

(56) References Cited

U.S. PATENT DOCUMENTS 4,772,881 * 9/1988 Hannah ..... 345/150
5,115,232 * 5/1992 Iizuka ..... 345/99
5,266,936 11/1993 Saitoh ..... 345/98
5,365,284 * 11/1994 Matsumoto et al. ..... 345/99
5,523,772 * 6/1996 Lee ..... 345/100
5,675,353 * 10/1997 Tanaka et al. ..... 345/96
5,712,651 * 1/1998 Tomiyasu ..... 345/150
5,841,430 * 10/1998 Kurikko ..... 345/99
5,856,816 * 1/1999 Youn ..... 345/98
5,856,818 * 1/1999 Oh et al. ..... 345/99

* cited by examiner

*Primary Examiner*—Amare Mengistu
(74) *Attorney, Agent, or Firm*—Fleshner & Kim, LLP

(57) ABSTRACT

A driving voltage supply circuit according to the present invention for an LCD panel which is capable of reducing the power consumption. The noise effect of the circuit is also reduced by reducing an operational frequency of the shift register to one half of an input clock frequency and driving the circuit by using the thusly one-half-reduced clock frequency. The circuit includes first and second input unit that separates and processes data into an (2n+1)th data and a (2n)th data and output the processed data in accordance with a control signal. A divider divides the input clock signal operating the first and second input unit, and a shift register controls the transmission of color signal data from the first and second input units in accordance with a shift register start pulse signal sequentially shifted through n-number of shift registers and the divided clock signal. An output device including a latch unit holds the data from the first and second input units in accordance with the shift register start signal from the shift register until the next color signal data is inputted. A digital/analog converter of the output device converts color signal data from the latch unit into an analog signal, and an output buffer of the output device buffers an output signal from the digital/analog converter to a predetermined level for output to the LCD panel.

11 Claims, 3 Drawing Sheets

DRIVING VOLTAGE SUPPLY CIRCUIT FOR LIQUID CRYSTAL DISPLAY (LCD) PANEL

BACKGROUND OF THE INVENTION

1. Field of the Invention

The present invention relates to a driving voltage supply circuit and in particular, to an improved driving voltage supply circuit for a Liquid Crystal Display (LCD).

2. Background of the Related Art

FIG. 1 is a circuit diagram illustrating a related driving voltage supply circuit for an LCD panel. As shown therein, the related driving voltage supply circuit for an LCD panel includes an LCD controller 10, and an input unit 11 that processes 6-bit color signals R, G, and B from the LCD controller 10 in each cycle of the clock signal CLK. The input unit 11 outputs color signal data R[5:0], G[5:0], and B[5:0] to a latch 13. A shift register 12 comprises a plurality of shift registers connected in series, and shifts a shift register start pulse signal SSP in accordance with the clock signal CLK when the shift register start pulse signal SSP is inputted.

A latch unit 13 outputs a signal in accordance with an output enable signal OE when data corresponding to one line is inputted thereto wherein the output data from the input unit 11 is controlled by the output signal from the shift register 12. A digital/analog converter 14 converts the digital color signal data from the latch unit 13 into an analog color signal, and an output buffer 15 buffers the output signal from the digital/analog converter 14 to a predetermined level.

When the color signals R, G, and B and synchronous signals H-SYNC and V-SYNC are inputted, the LCD controller 10 transmits the color signals synchronized with respect to the horizontal synchronous signal H-SYNC and vertical synchronous signal V-SYNC to the input unit 11. The input unit 11 processes the 6-bit color signals from the LCD controller 10 in each cycle of the clock signal CLK. Therefore, the input unit 11 outputs the color signal data R[5:0], G[5:0], and B[5:0] of 18 bits, which were processed in 6 bits with respect to each of the color signals R, G, and B, to the latch unit 13.

In the shift register 12, which includes a plurality of shift registers (not shown), the SSP signal is sequentially shifted in accordance with the clock signal CLK when the SSP signal is applied to a first shift register (not shown). Whenever the SSP signal is outputted through the last shift register (not shown), the color signal from the input unit 11 is inputted into the latch unit 13.

The latch unit 13 holds the color signal from the data input unit 11 in accordance with the output signal from the shift register 12 until the next color signal data is inputted. When the output enable signal OE is inputted, the color signal data from the input unit 11 is transmitted to the digital/analog converter 14. The digital/analog converter 14 converts the digital color signal data from the latch unit 13 into analog color signals, and then transmits the analog color signals to the output buffer 15. The output buffer 15 buffers the analog color signals R, G, and B to a predetermined level. The output voltage from the output buffer 15 is supplied to each pixel of the LCD panel, so that the LCD panel is activated by the color signal voltage.

In the related art, since the operation frequency of the shift register and the input frequency of the clock signal CLK are identical, the power consumption is increased. Accordingly, the circuit may be easily influenced by noise, which causes electromagnetic interference.

The above references are incorporated by reference herein where appropriate for appropriate teachings of additional or alternative details, features and/or technical background.

SUMMARY OF THE INVENTION

Accordingly, it is an object of the present invention to provide a driving voltage supply circuit for an LCD panel which overcomes the aforementioned problems encountered in the related art.

It is another object of the present invention to reduce the power consumption of an LCD panel.

Another object is to reduce a noise effect to the circuit.

A further object is to reduce an operational frequency of the shift register to one-half of an input clock frequency and driving the driving voltage supply circuit by using the thusly one-half-reduced frequency.

To achieve the above objects, there is provided a driving voltage supply circuit for an LCD panel which includes first and second input unit for separating and processing a data into an (2n+1)th data and a (2n)th data and outputting the processed data in accordance with a second control signal, a divider for dividing the clocks from the first and second input unit into the n-number of clocks and reducing an operational frequency of a shift register, a shift register for transmitting color signal data from the first and second input unit to the next circuit when the n-number of shift registers is sequentially shifted in accordance with a shift register start pulse signal whenever a clock which was divided is inputted, a latch unit for holding the data from the first and second input units in accordance with a shift register start signal from the shift register until the next color signal data is inputted, a digital/analog converter for converting a digital color signal data from the latch unit into an analog signal, and an output buffer for buffering an output signal from the digital/analog converter to a predetermined level for being outputted to the LCD panel.

The present invention may be achieved in parts or in a whole by a driving circuit for a display device, comprising: a first input unit that receives a first group of display data; a second input unit that receives a second group of display data; a divider coupled to receive a first clock signal of a first frequency, the divider changing the first clock signal by a prescribed amount to output a second clock signal of a second frequency, where the first and second frequencies are not equal to one another; a shift register unit coupled to the divider, and responsive to the second clock signal to shift an input control signal and to output a plurality of output signals; and an output device coupled to the first and second input units and the shift register unit such that the output device outputs the first and second groups of display data to the display device.

The present invention may be achieved in parts or in a whole by a method of operating a driving circuit of a display device, the method comprising the steps of: separating a plurality of display data into odd and even display data; converting a first clock signal to a second clock signal, where the first and second clock signal have different frequencies; controlling a transmission of even and odd display data in response to the second clock signal and a first control signal; and outputting the even and odd display data in response to a second control data.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

Figure 1:
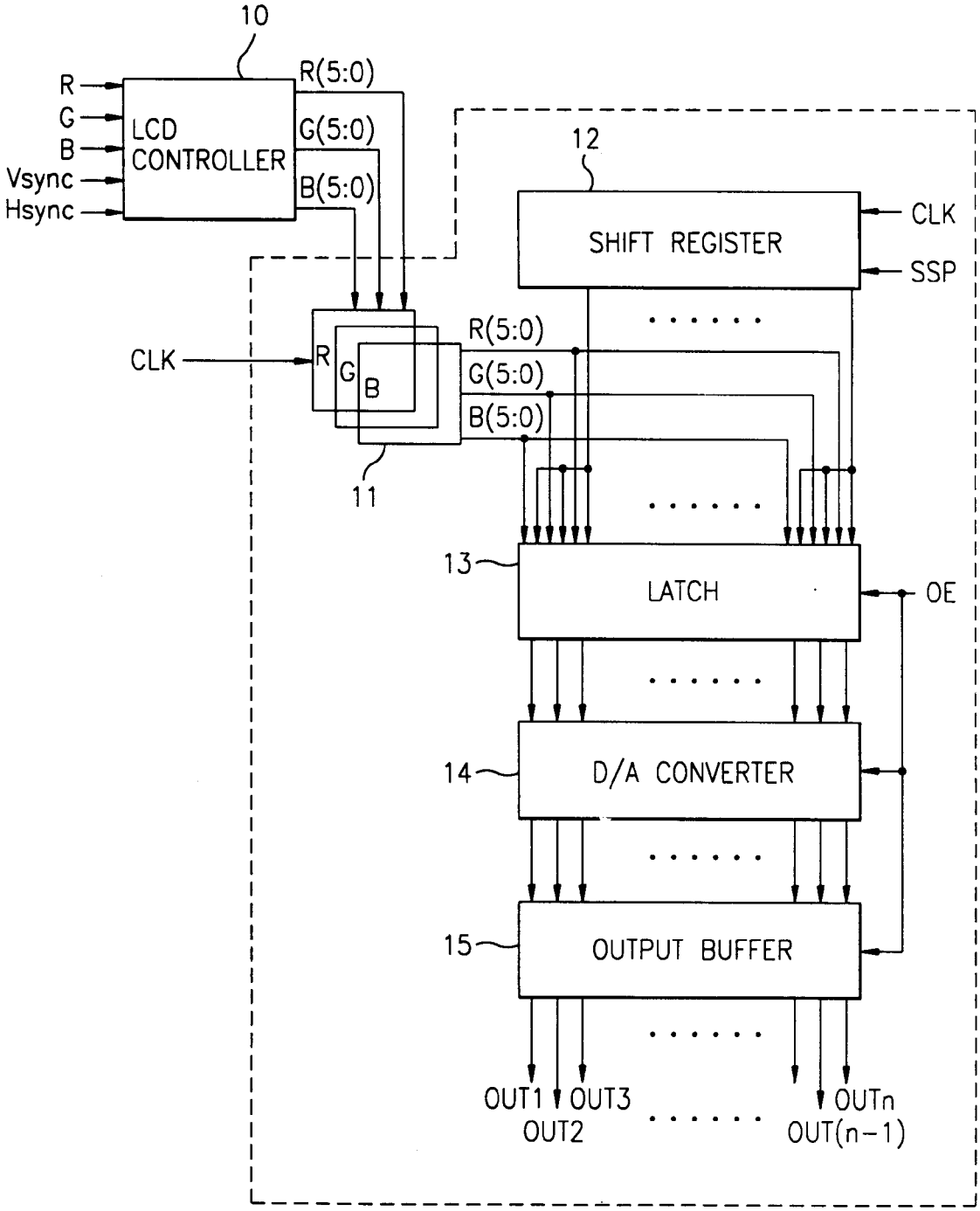
FIG. 1 BACKGROUND ART
FIG. 1 is a block circuit diagram illustrating a related driving voltage supply circuit for an LCD panel.
Figure 2:
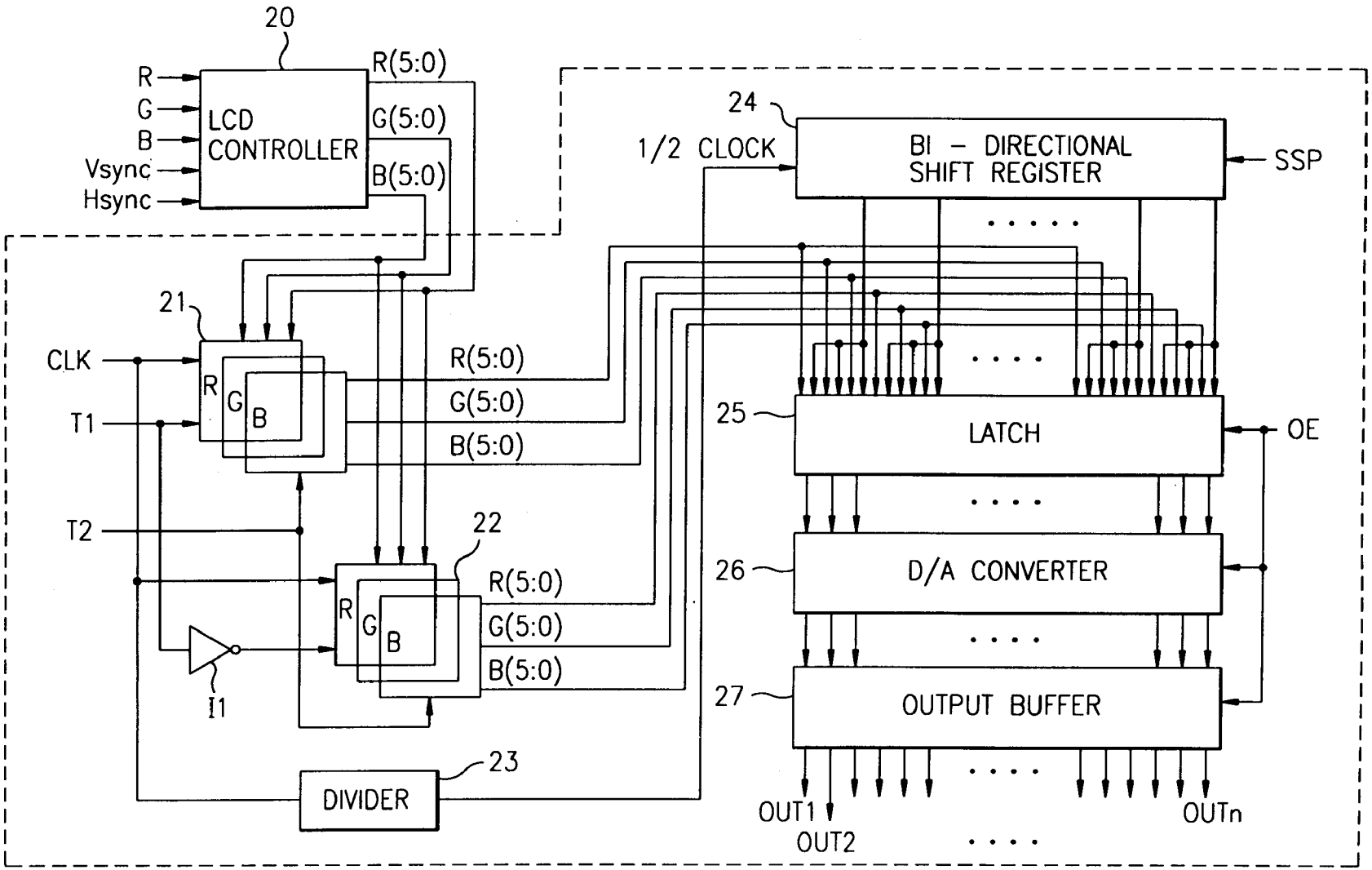
FIG. 2 is a block circuit diagram illustrating a driving voltage supply circuit for an LCD panel according to a preferred embodiment of the present invention.

FIG. 2 is a circuit diagram illustrating a driving voltage supply circuit for an LCD panel according to a preferred embodiment of the present invention. As shown therein, the driving voltage supply circuit for the LCD panel according to the present invention includes an LCD controller 20, first and second input units 21 and 22 that separates color signal data from the LCD controller 20 into (2n+1)th data and (2n)th data in accordance with a first control signal T1. The first and second in put units 21 and 22 process the data inputted thereinto, and output the processed data in accordance with a second control signal T2. A divider 23 divides a clock signal CLOCK applied to the first and second input units 21 and 22 by one-half. The divided clock signal, preferably ½ the frequency of the clock signal CLOCK, reduced the operational frequency of a bidirectional shift register.

A bi-directional shift register 24 controls the transmission of the color signal data from the first and second input units 21 and 22 to the next circuit stage at the ½ clock frequency divided by the divider 23 when the n-number of shift registers are sequentially shifted in accordance with a shift register start pulse SSP. A latch unit 25 holds the color signal data from the first and second input units 21 and 22 until the next color signal data is inputted thereto in accordance with the shift register start pulse SSP signal from the bidirectional shift register 24 and outputs the color signal data to the next circuit stage when an output enable signal OE is inputted thereto. A digital/analog converter 26 converts the digital color signal data from the latch unit 25 into analog signals, and an output buffer 27 buffers the output signals from the digital/analog converter 26 to a predetermined level for output to the LCD panel.

Figure 3:
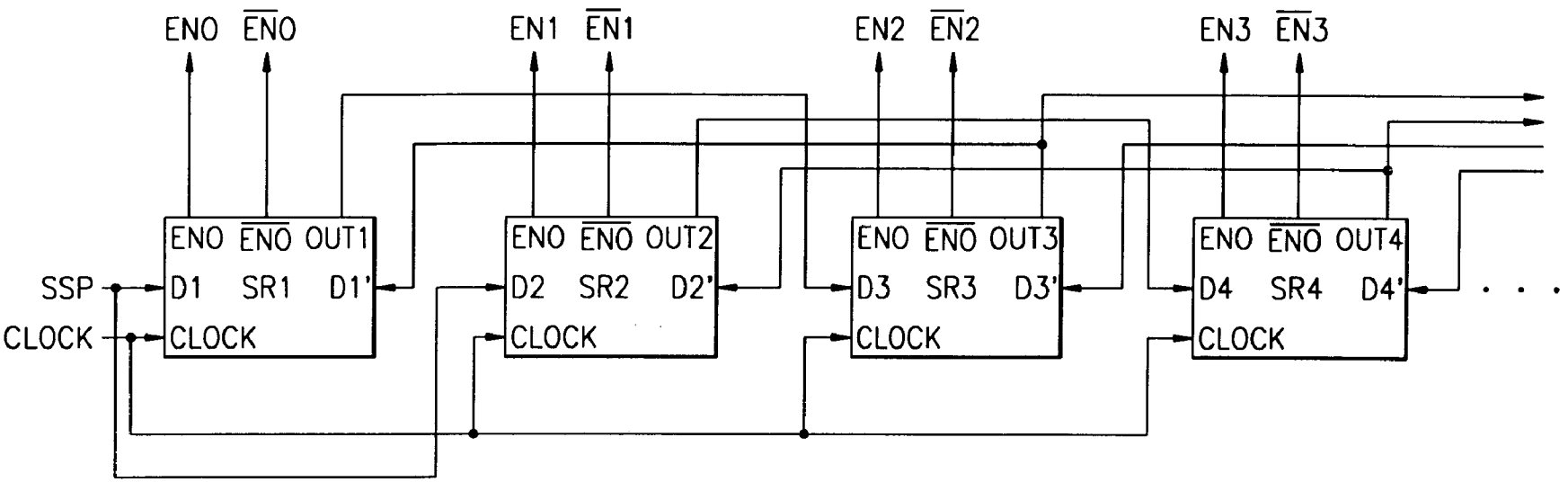
FIG. 3 is a detailed block circuit diagram illustrating a bidirectional shift register of the circuit of FIG. 2 according to a preferred embodiment of the present invention.

FIG. 3 is a detailed block diagram illustrating a bidirectional shift register 24 of FIG. 2 according to a preferred embodiment of the present invention. A first shift register SR1 receives the shift register start pulse SSP through a first input terminal D1 and the divided clock signal ½ CLOCK through a clock terminal CLK1. The first shift register SR1 has an output terminal OUT1 and a second data input terminal D1' connected with a first data input terminal D3 and an output terminal OUT3 of a third shift register SR3, respectively. A first data input terminal D2 of a second shift register SR2 receives the shift register start pulse SSP and the divided clock signal ½ CLOCK through a first data input terminal D2 and a clock terminal CLK2, respectively, thereof. The second shift register SR2 has an output terminal OUT2 and a second data input terminal D2' thereof connected with a first data input terminal D4 and an output terminal OUT4 of a fourth shift register SR4, respectively. Namely, in the shift register 24, the (2n+1)th shift registers are connected with the input/output terminals of the subsequent (2n+1)th registers, and the (2n)th shift registers are connected with the input/output terminals of the subsequent (2n)th shift registers, respectively. In other words, the odd shift registers, (2n+1) registers, are coupled to each other, and the even shift registers, (2n) registers, are coupled to each other.

When the color signals R, G, and B and synchronous signals H-SYNC and V-SYNC are externally inputted, the LCD controller 20 transmits the color signal data which are synchronized with respect to the horizontal synchronous signal H-SYNC and vertical synchronous signal V-SYNC, to the first input unit 21 and second input unit 22, respectively. The color signal data R, G and B are inputted into the first input unit 21 or the second input unit 22 in accordance with the first control signal T1.

When the first control signal T1 of a first prescribed signal level is inputted into the first input unit 21, the first control signal T1, which is inverted by inverter I1, is inputted into the second input unit 22. The first input unit 21 receives the data from the LCD controller 20 and the second input unit 22 does not receive the data. When the first control signal T1 of a second prescribed signal level is inputted into the first input unit 21, the first control signal T1, which is inverted by the inverter I1, is inputted into the second input unit 22, whereby the first input unit 21 does not receive the data from the LCD controller 20, and the second input unit 22 receives the data from the LCD controller 20.

As a result, when the first input unit 21 receives the data of the color signals R, G, and B, the second input unit 22 is not operated and holds the previously received data. When the second input unit 22 does receive the color signals R, G and B, the first input unit 21 is not operated, and holds the previously received data.

In addition, since each of the first input unit 21 and the second input unit 22 process the 6-bit color signals R, G, and B from the LCD controller 20 in one cycle of clock signal CLOCK, the color signal data processed by the first input unit 21 is 18-bits, and the color signal data processed by the second input unit 22 is 18-bits. As the color signal data from the LCD controller 20 are alternately received in accordance with the first control signal T1, when the data are all inputted into the first input unit 21 and the second input unit 22, respectively, the second control signal T2 is inputted into the first and second input units 21 and 22. Thereafter, the first input unit 21 and the second input unit 22 output the processed data to the latch unit 25. The color signal data of 36 bits processed by the first input unit 21 and the second input unit 22 are outputted into the latch unit 25.

The divider 23 receives the clock signal CLOCK which is also applied to the first input unit 21 and the second input unit 22, and divides the clock signal CLOCK by a prescribed amount to reduce the operational frequency. Preferably, the clock signal CLOCK is divided by one-half. When the divider 23 outputs the divided clock signal ½ CLOCK to the bidirectional shift register 24, the bi-directional shift register 24 synchronizes the shift register start pulse SSP with respect to the ½ clock frequency of the divided clock signal ½ CLOCK. When the start pulses are sequentially shifted, and the start pulse passes the last shift register, the output signals ENO-ENn and /ENO-/ENn are outputted to the latch unit 25. The latch unit 25 receives the output data from the first input unit 21 and the second input unit 22. Namely, only when the bi-directional shift register 24 outputs a pulse, the latch unit 25 receives the color signal data from the first input unit 21 and the second input unit 22, respectively.

The latch unit 25 holds the output data from the first input unit 21 and the second input unit 22 in accordance with the control of the shift register 24 until the next color signal data is inputted. When the output enable signal OE is inputted, the data is outputted to the digital/analog converter 26. The digital/analog converter 26 converts the digital color signal data from the latch unit 25 into an analog color signal and outputs the signal to the output buffer 27. The output buffer 27 buffers the signal to a predetermined level for output to the LCD panel, such that the R, G, and B data voltage is inputted to each pixel of the LCD panel, whereby the LCD panel is driven.

In the bi-directional shift register 24, which is operated in accordance with the ½ frequency cycle of the divided clock signal ½ CLOCK, the odd and even shift registers of n-number of shift registers SR, as shown in FIG. 3, are connected in series with each other, respectively. Namely, the output terminal OUT1 of the first shift register SR1 which receives the shift register start pulse SSP through the first data input terminal D1 and the divided signal clock ½ CLOCK through the clock terminal CLK1 is connected with the first data input terminal D3 of the third shift register SR3. The output terminal OUT3 of the third shift register SR3 is connected with the second input terminal D1' of the first shift register SR1 and the first input terminal of the fifth shift register, respectively.

The output terminal OUT2 of the second shift register SR2 which receives the shift register start pulse SSP through the first data input terminal D2 and the divided clock signal ½ CLOCK through the clock terminal CLK2 is connected with the first data input terminal D4 of the fourth shift register SR4 (not shown), and the output terminal OUT4 of the fourth shift register SR4 is connected with the second data input terminal D2' of the second shift register SR2 and the first input terminal of the sixth shift register, respectively.

As a result, the output terminal of the (2n+1)th shift register (odd shift register) and the second data input terminal are connected with the first data input terminal and the output terminal of the subsequent (2n+1)th shift register. The output terminal and the second input terminal of the (2n)th shift register are connected with the first data input terminal and the output terminal of the (2n)th shift register (even shift registers). The n-number of shift registers SR1 through SRn of the shift register 24 are shifted whenever the divided clock signal ½ CLOCK is inputted into the clock terminal.

As described above, the driving voltage supply circuit for a liquid crystal display(LCD) panel according to the present invention separates the color signal from the LCD controller into (2n +i)th data and (2n)th data for two input units, processes the data as 36 bits, divides the operational frequency of the shift register into one-half of the input clock frequency, and operates the shift register by using the thusly reduced operational frequency, which reduces the power consumption. In addition, it is possible to prevent the circuit from being affected by noise by reducing the operational frequency of the shift register.

The foregoing embodiments are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

What is claimed is:

1. A driving voltage supply circuit for a liquid crystal display(LCD) panel, comprising:

first and second input means for separating and processing three color signal data into an (2n+1)th data and a (2n)th data and outputting the processed data in accordance with a control signal, wherein n is an integer greater than 0 such that the first and second input means each process half the three color signal data;

a divider means for dividing a clock signal operating the first and second input means;

a shift register means connected to the divider means for controlling a transmission of color signal data from the first and second input means by concurrently outputting a first plurality of control signals and a second plurality of control signals in accordance with a shift register start pulse signal sequentially shifted through n-number of shift registers and the divided clock signal;

a latch means connected to the first and second input means and the shift register means for concurrently holding data from the first and second input means in accordance with the shift register start pulse signal and the first and second plurality of control signals from the shift register means until the next color signal data is inputted, wherein the latch means has a first set of terminals connected to the first input means and a second set of terminals connected to the second input means;

a digital/analog conversion means for converting the color signal data from the latch means into an analog signal; and an output buffer means for buffering an output signal from the digital/analog conversion means to a predetermined level for being outputted to the LCD panel.

2. The circuit of claim 1, wherein said divider means is a ½ divider.

3. The circuit of claim 1, wherein in said shift register means, an output terminal and a data input terminal of an (2n+1)th shift register are connected with a data input terminal and an output terminal of another (2n+1)th shift register, respectively, and an output terminal and a data input terminal of a (2n)th shift register are connected with a data input terminal and an output terminal of another (2n)th shift register, respectively.

4. The driving voltage supply circuit of claim 1, wherein the divider means divides a frequency of the clock signal, and the divided clock signal has a frequency less than a frequency of the clock signal, wherein the three color signal data comprises a row of LCD panel data, and wherein the first and second sets of terminals are equal in number.

5. A driving circuit for a display device, comprising:

a first input unit that receives a first group of three color display data and responsive to a first clock signal;

a second input unit that receives a second group of three color display data and responsive to the first clock signal;

a converter coupled for receiving the a first clock signal of a first frequency, said converter changing the first clock signal by a prescribed amount to output a second clock signal of a second frequency, where the first and second frequencies are not equal to one another;

a shift register unit coupled to said converter, and responsive to said second clock signal to shift an input control signal and to output a plurality of latch control signals; and a latch having first and second groups of input terminals respectively coupled to said first and second input units to receive the first and second groups of three color data responsive the latch control signals, wherein the latch is connected to said shift register unit such that said latch concurrently holds the first and second groups three color of display data; and an output device connected to the latch such that the output device outputs the first and second groups of three color data to the display device.

6. The driving circuit of claim 5, wherein said converter is a divider which divides the first clock signal by the prescribed amount to output the second clock signal.

7. The driving circuit of claim 6, wherein said divider divides the first clock signal by one-half to output the second clock signal having a second frequency which is one-half of the first frequency.

8. The driving circuit of claim 5, wherein said shift register unit is bi-directional.

9. The driving circuit of claim 5, wherein said shift register unit comprises n-number of shift registers, and (2n+1) shift registers are coupled to one another and (2n) shift registers are coupled to one another, wherein n is an integer greater than 0.

10. The driving circuit of claim 5, wherein said output device comprises:

a latch unit to hold the first and second groups of display data;

a digital-to-analog converter that converts the first and second groups of display data into an analog signal; and a buffer that buffers the analog signal for output to the display device.

11. The driving circuit of claim 5, wherein the first group of display data comprises a (2n+1)th data and the second group of display data comprises a (2n)th data from a plurality of color signal data.

* * * * *